US010254032B2

(12) United States Patent
Knatt

(10) Patent No.: US 10,254,032 B2
(45) Date of Patent: Apr. 9, 2019

(54) ICE DISCHARGING APPARATUS FOR VERTICAL SPRAY-TYPE ICE MACHINES

(71) Applicant: True Manufacturing Co., Inc., O'Fallon, MO (US)

(72) Inventor: Kevin Knatt, St. Louis, MO (US)

(73) Assignee: True Manufacturing Co., Inc., O'Fallon, MO (US)

( * ) Notice: Subject to any disclaimer, the term of this patent is extended or adjusted under 35 U.S.C. 154(b) by 34 days.

(21) Appl. No.: 15/646,235

(22) Filed: Jul. 11, 2017

(65) Prior Publication Data

US 2018/0017304 A1 Jan. 18, 2018

Related U.S. Application Data

(60) Provisional application No. 62/362,693, filed on Jul. 15, 2016.

(51) Int. Cl.

| | |
|---|---|
| ***F25C 1/12*** | (2006.01) |
| ***F25C 1/25*** | (2018.01) |
| ***F25C 5/182*** | (2018.01) |

(52) U.S. Cl.

CPC ..... *F25C 1/12* (2013.01); *F25C 1/25* (2018.01); *F25C 5/182* (2013.01); *F25C 2400/04* (2013.01); *F25C 2400/14* (2013.01)

(58) Field of Classification Search

CPC ..... F25C 1/12; F25C 1/25; F25C 2400/04; F25C 2400/14; F25C 5/182

See application file for complete search history.

(56) References Cited

U.S. PATENT DOCUMENTS

| | | | | |
|---|---|---|---|---|
| 4,075,865 | A | 2/1978 | Willis | |
| 4,191,205 | A * | 3/1980 | Nash | F16K 15/03 137/375 |
| 4,197,717 | A | 4/1980 | Schumacher | |
| 4,257,237 | A | 3/1981 | Hoenisch | |
| 4,505,130 | A | 3/1985 | Hibino et al. | |
| 4,602,489 | A | 7/1986 | Hara | |

(Continued)

FOREIGN PATENT DOCUMENTS

WO 2004057248 A1 7/2004

OTHER PUBLICATIONS

Patent Cooperation Treaty, International Search Report for PCT/US2017/041442, 3 pages dated Oct. 17, 2017.

*Primary Examiner* — Filip Zec

(74) *Attorney, Agent, or Firm* — Stinson Leonard Street LLP

(57) ABSTRACT

An ice making machine having a refrigeration system and a water system, the water system having a water reservoir located below a freeze plate adapted to hold water, and a sprayer assembly located below the freeze plate for spraying water from the water reservoir toward the pockets. An inclined ice slide is positioned below the freeze plate and above the sprayer assembly directing fallen ice toward an opening. A divider assembly separating the water system from the ice storage bin includes a plurality of dividers, wherein the dividers may rotate outwardly away from the opening to allow formed ice to fall into the ice storage bin. Each divider is formed from a generally rectangular body having a front face with a triangular-shaped thickness and an extension flap extending away from the body opposite the front face.

12 Claims, 8 Drawing Sheets

(56) References Cited

U.S. PATENT DOCUMENTS 4,619,117 A 10/1986 Ito
4,733,539 A 3/1988 Josten et al.
4,867,802 A * 9/1989 Earl ..... E03C 1/122 137/526
4,910,974 A 3/1990 Hara
4,913,315 A 4/1990 Wagner
5,025,637 A 6/1991 Hara
5,027,610 A 7/1991 Hara
5,035,118 A 7/1991 Hara
5,193,357 A 3/1993 Kohl et al.
5,419,151 A 5/1995 Minari et al.
5,552,448 A 6/1996 Schwanebeck
5,533,352 A 7/1996 Bahel et al.
5,752,393 A 5/1998 Schlosser et al.
5,806,330 A 9/1998 Falkowski
5,878,583 A 3/1999 Schlosser et al.
5,901,561 A 5/1999 Allison et al.
6,058,731 A 5/2000 Byczynski
6,101,833 A 8/2000 Suzuki
6,119,469 A 9/2000 Elwood
6,120,685 A 9/2000 Carlson et al.
6,148,621 A 11/2000 Byczynski et al.
6,216,479 B1 4/2001 Elwood
6,257,009 B1 7/2001 Tsuchikawa
6,303,031 B1 10/2001 Senner
6,311,501 B1 11/2001 Allison et al.
6,355,177 B2 3/2002 Senner et al.
6,375,834 B1 4/2002 Guess et al.
6,438,973 B1 8/2002 Yoshida et al.
6,453,696 B1 9/2002 Kawasumi et al.
6,502,416 B2 1/2003 Kawasumi et al.
6,612,126 B2 9/2003 Kawasumi et al.
6,705,107 B2 3/2004 Schlosser et al.
7,281,386 B2 10/2007 McDougal et al.
7,444,828 B2 11/2008 Kadowaki et al.
2003/0009610 A1 1/2003 Nolan et al.
2003/0182958 A1 10/2003 Gray et al.
2004/0226312 A1 11/2004 Miller et al.
2005/0044875 A1 3/2005 Schlosser et al.
2007/0119202 A1 5/2007 Kadowaki et al.
2009/0249804 A1 10/2009 Davis et al.
2010/0024442 A1* 2/2010 Damrath ..... F25C 1/00 62/66
2016/0146524 A1 5/2016 Bortoletto et al.

* cited by examiner

ICE DISCHARGING APPARATUS FOR VERTICAL SPRAY-TYPE ICE MACHINES

FIELD OF THE INVENTION

This invention relates generally to automatic ice making machines and, more specifically, to vertical spray-type ice making machines having a unique divider assembly for separating the ice-making zone from the ice storage bin.

BACKGROUND

Vertical spray-type ice making machines are well-known and are used extensively in residential and commercial applications. A typical residential ice-making machine may be sized to fit beneath a standard countertop and often includes options for attaching overlay doors to match the surrounding cabinetry. Behind the door, a foamed, self-contained ice storage bin has space for approximate 20-30 pounds of clear ice cubes. The geometry of the ice cubes is unique to the various ice maker manufacturers; round, square, and sometimes octagonal shapes of various sizes can be created. Virtually clear ice is formed by spraying water upwards towards a freeze plate having a plurality of ice making pockets. A pump motor recirculates the water for a continuous stream throughout the freezing cycle. As the pure water freezes first, the impurities fall back into the recirculating tank. The remaining ice on the freeze plate is of high quality—very pure—and highly desirable for home bars, boutiques, and small commercial applications.

Several key components comprise the automatic ice making machine. The refrigeration system typically includes a compressor, hot gas valve, condenser and fan motor assembly, expansion device, and an evaporator assembly including a freeze plate having copper cups or pockets thermally coupled to a serpentine tube. The components of the refrigeration system are coupled together with tubing charged with a refrigerant. The evaporator pockets are typically coated with electroplated tin to prevent the cups from corroding and to provide a safe, sanitary surface for making ice. The opening of the cups face downward toward the stream of water provided by the water recirculation system. The water system includes a water reservoir, circulation pump, and sprayer assembly for distributing water to the pockets. A control system operates the necessary sequence of components to accomplish the freeze and harvest cycling. The process is continued until the ice bin reaches a desired level. The ice bin level may be detected by a control device such as a thermostatic element tied to a signal relay. When the ice approaches the sensor, a signal is sent to the controller to halt the making of ice until the demand returns. In some cases, an external display is included to show the operating status of the machine, to show when the bin is full, or to allow the end user to diagnose errors or select various operating parameters.

Once the harvest is initiated, the controller deactivates the condensing fan and opens the bypass valve to redirect the hot gas discharged from the compressor directly to the evaporator. As the evaporator warms slowly, the ice partially melts, and the bonds between the ice and the pockets of the freeze plate are broken. A released cube falls down toward an inclined ice slide which guides it obliquely towards the opening of the evaporator housing. Then, by its own weight, the cube falls through a separating device and into the ice storage bin. Within a few minutes, all of the ice releases from the freeze plate. Once the allotted harvest time has completed, the controller restarts the ice making sequence, and the process repeats until the storage bin is full.

Particular attention must be given to the design of the separating device. As is the case with vertical spray type ice machines, water can easily escape from the recirculating system due to the spaces between and around the individual dividers of the separating device. A decrease in water level directly translates to a loss in ice capacity, especially in the case of the aforementioned single-parameter systems; therefore, the sum of the width of the individual dividers must completely span the width of the opening, and the gaps between each divider must be held to a minimum. Another issue is that the dividers must be able to swing freely open for all harvested ice cubes regardless of their weight. This can be particularly challenging in that the flat back side of the conventional divider rests against the ice chute to its rear. During the freeze cycle, the addition of recirculating water between the divider and ice chute often creates a surface tension between the two parts, usually, enough to prevent the divider from opening during the subsequent harvest. This phenomena exists despite absence of flowing water—i.e., the surface tension remains. As a result, the ice cubes have the tendency to build up within the housing and can lead to a much larger failure, such as a block of un-harvestable ice formed over the evaporator. The excess ice significantly lowers the temperature of the refrigerant leaving the evaporator. The liquid refrigerant, which would normally boil off in the evaporator, now has the chance of returning to the compressor and causing permanent damage to the piston-cylinder assembly. Therefore, in order to prevent a myriad unwanted errors, particular care must be given to the design of separating device.

One method chosen to address the aforementioned problems is explained in U.S. Pat. No. 7,444,828, which describes using a plurality of ribs extending vertically off of the ice chute to prevent adhesion between itself and separating device. The space created around the rib reduces the surface tension and allows space for the recirculating water to flow. Another embodiment described includes other special geometry applied to the separator itself, such as vertical ribs or a plurality of convex pieces, to prevent the same. The solution presented merely reduces the possibility of adhesion but ultimately does not eliminate it altogether, especially for small or incomplete batches that occur after random shut-downs of the machine, through the loss of water pressure during a previous fill cycle, or from the build-up of sediment or deposits in the sprayer head nozzle. An improvement would be to prevent contact of the divider with any adjacent component altogether and, yet, still achieve the ultimate goal of water retention. Any alternative solution must prove to reliably harvest ice cubes of all sizes; it must allow the free swinging of individual dividers with respect to one another; it must prevent water from escaping between the curtains by adhering to tight tolerances; and, therefore, must be a completely unique solution to what is described in the prior art.

SUMMARY OF THE INVENTION

Briefly, therefore, one embodiment of the invention is directed to an ice maker having a refrigeration system comprising a compressor, a condenser, a hot gas valve, and a thermal expansion device. An evaporator assembly having a refrigerant tubing in fluid communication with the refrigeration system is thermally coupled to a freeze plate having a plurality of ice-forming pockets. A water system for supplying water to the pockets of the freeze plate includes a water reservoir located below the freeze plate adapted to hold water, and a sprayer assembly located below the freeze plate for spraying water from the water reservoir toward the pockets. The ice maker also includes an ice storage bin for retaining the formed ice. An inclined ice slide is positioned below the freeze plate and above the sprayer assembly directing fallen ice toward an opening between the water system and the ice storage bin. A divider assembly is positioned within the opening, the divider assembly having a plurality of dividers, wherein the dividers may rotate about an axis of rotation at a proximal end of the dividers outwardly away from the opening to allow formed ice to fall into the ice storage bin. The dividers are formed as a generally rectangular body having a front face and an extension flap at the proximal end of the divider extending away from the body opposite the front face. The front face of the dividers may include a triangular-shaped thickness. The distal end of the dividers in their closed position and the end face of the ice slide may define a gap separating the distal end of the dividers and the end face of the ice slide. The divider assembly may also include an attachment bracket for securing the dividers to the ice maker, the attachment bracket having an inner horizontal surface engaging the extension flap to maintain the gap between the distal end of the dividers and the end face of the ice slide.

Another embodiment is directed to an ice discharging apparatus for use in a vertical spray-type ice making machine having a water spraying assembly positioned below a freeze plate, and an ice bin. The apparatus includes an inclined ice slide positioned below the freeze plate and above the sprayer assembly directing fallen ice toward an opening to the ice storage bin. A divider assembly is positioned within the opening, the divider assembly having a plurality of dividers, wherein the dividers may rotate about an axis of rotation at a proximal end of the dividers outwardly away from the opening to allow formed ice to fall into the ice storage bin. The dividers are formed as a generally rectangular body having a front face and an extension flap at the proximal end of the divider extending away from the body opposite the front face. The front face of the dividers may include a triangular-shaped thickness. The distal end of the dividers in their closed position and the end face of the ice slide may define a gap separating the distal end of the dividers and the end face of the ice slide. The divider assembly may also include an attachment bracket for securing the dividers to the ice maker, the attachment bracket having an inner horizontal surface engaging the extension flap to maintain the gap between the distal end of the dividers and the end face of the ice slide.

BRIEF DESCRIPTION OF THE FIGURES

These and other features, aspects and advantages of the invention will become more fully apparent from the following detailed description, appended claims, and accompanying drawings, wherein the drawings illustrate features in accordance with exemplary embodiments of the invention, and wherein:

DETAILED DESCRIPTION

Before any embodiments of the invention are explained in detail, it will be understood that the invention is not limited in its application to the details of construction and the arrangement of components set forth in the following description or illustrated in the following drawings. The invention is capable of other embodiments and of being practiced or of being carried out in various ways. Also, it will be understood that the phraseology and terminology used herein are for the purpose of description and should not be regarded as limiting. The use of "including," "comprising," or "having" and variations thereof is meant to encompass the items listed thereafter and equivalents thereof as well as additional items. All numbers expressing measurements and so forth used in the specification and claims are to be understood as being modified in all instances by the term "about." It should also be noted that any references herein to front and back, right and left, top and bottom and upper and lower are intended for convenience of description, not to limit an invention disclosed herein or its components to any one positional or spatial orientation.

Figure 1:
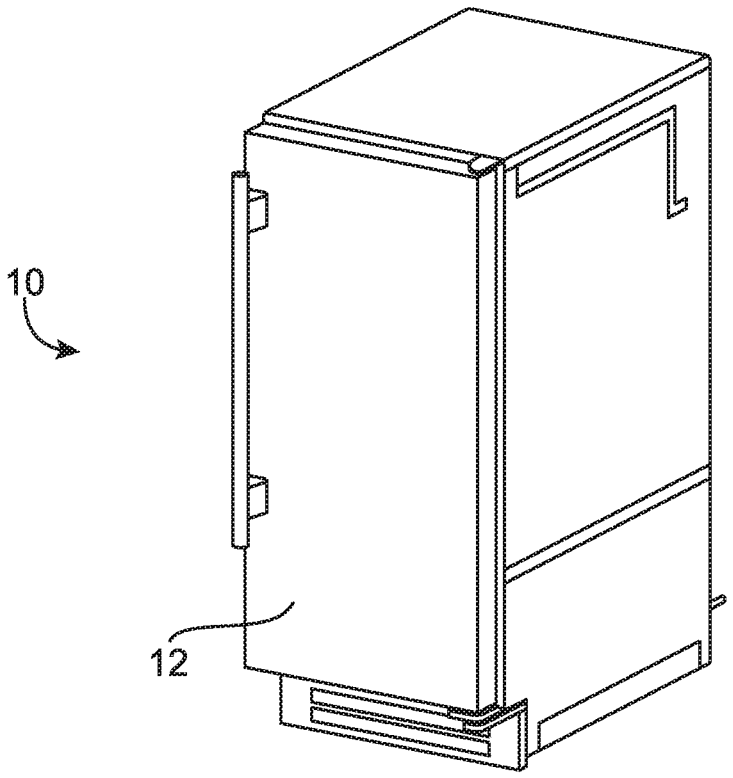
FIG. 1 is a perspective view of an ice maker.
Figure 2:
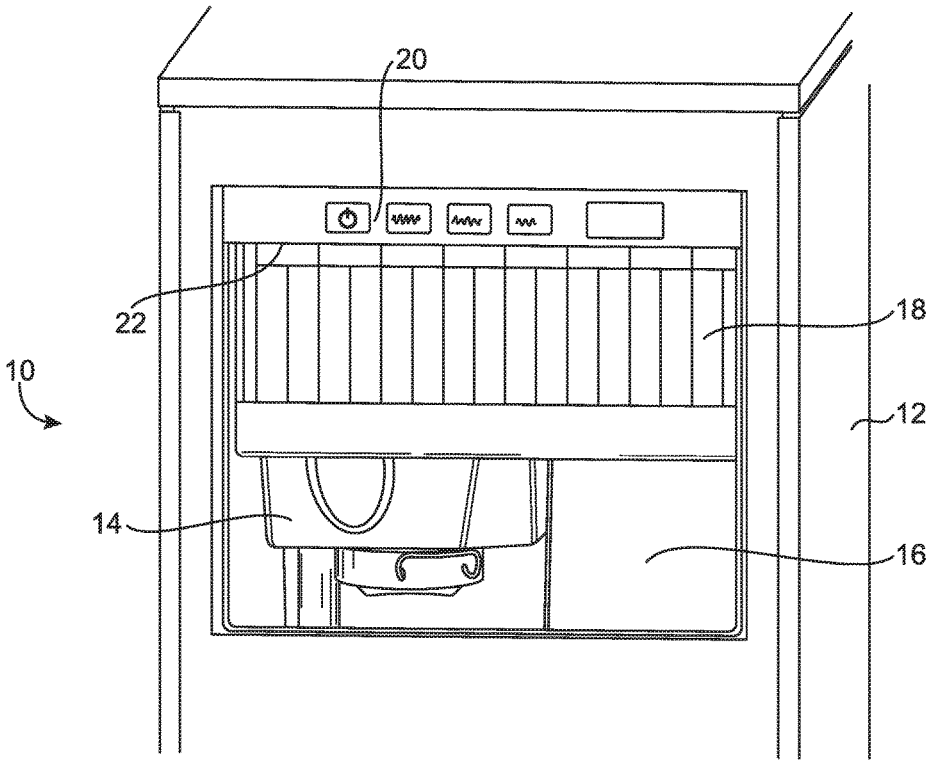
FIG. 2 is a front view of an ice maker with the door open and showing certain of the internal components.

FIGS. 1 and 2 illustrates a conventional ice maker 10 having an ice making assembly 14 disposed inside of a cabinet that may include a door 12. The ice making assembly 14, described in greater detail below, is at least partially hidden from view in FIG. 2 by the divider assembly 18. The ice making assembly 14 includes an opening separating the ice making assembly 14 and the ice storage bin 16, normally closed by the divider assembly 18, through which produced ice may pass to the ice storage bin 16. The opening is framed by the divider assembly 18. The ice maker 10 may include a control panel 20 having switches or buttons to switch the ice maker 10 on and off, to place the ice maker 10 in wash or clean mode, to turn on lights, and other controls as is known to those skilled in the art. The ice maker 10 may have other convention components not described herein without departing from the scope of the invention.

Figure 3:
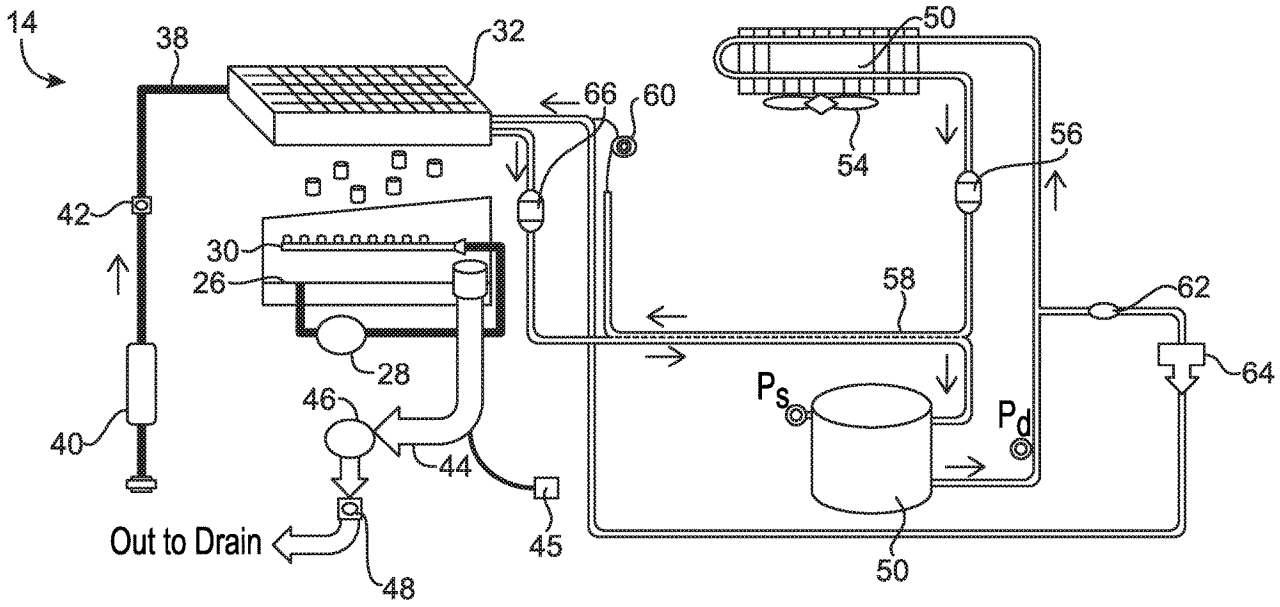
FIG. 3 is a schematic drawing of the ice making assembly according to one embodiment of the present invention.
Figure 4:
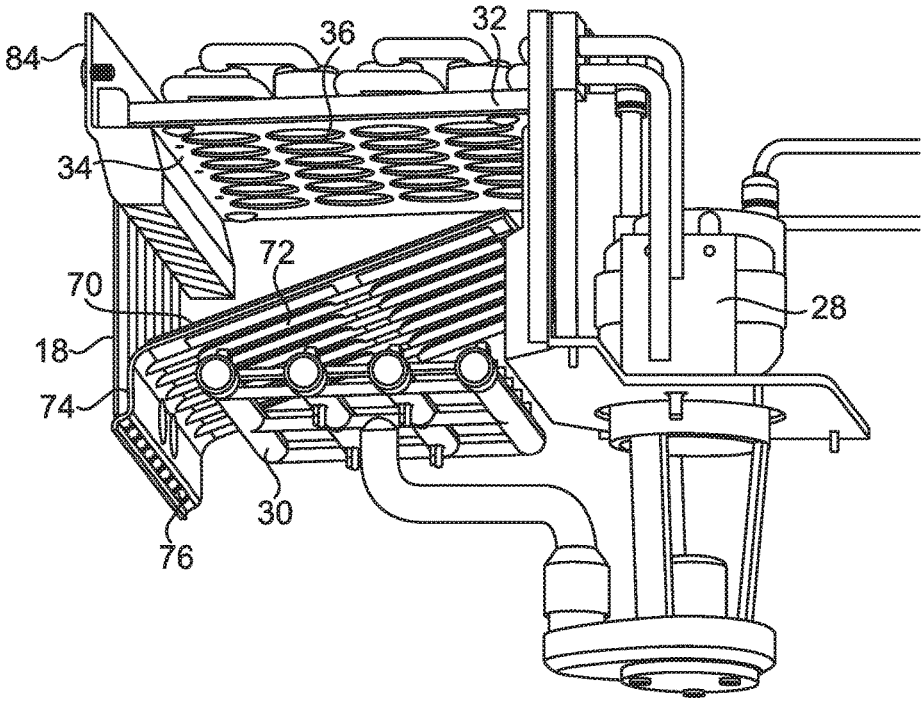
FIG. 4 is a perspective view of several components of the ice making assembly according to one embodiment of the present invention.

FIGS. 3 and 4 illustrates certain principal components of one embodiment of an ice making assembly 14 having a water system and a refrigeration system. The water system may include a water reservoir 26, water pump 28 circulating water from the water reservoir 26 to a water distribution sprayer 30 for spraying water up toward an evaporator assembly 32. During operation of the ice making assembly 14, as water is pumped from water reservoir 26 by water pump 28 through a water line and out of distributor sprayer 30, the water impinges on the pockets 36 of freeze plate 34 in thermal contract with the evaporator assembly 32 and freezes into ice. The water reservoir 26 may be positioned below the evaporator assembly 32 to catch any unfrozen water coming off of assembly 32 such that the water may be recirculated by water pump 28.

The water system may further include water supply line 38, water filter 40 and water inlet valve 42 disposed thereon for filling the water reservoir 26 with water from a water supply, wherein some or all of the supplied water may be frozen into ice. The water reservoir 26 may include some form of a water level sensor, such as a float or conductivity meter, as is known in the art. The water system may further include a water drain line 44, a pressure switch 45 coupled to the drain line 44, drain pump 46 and check valve 48 for draining water out of the water reservoir 26 as necessary.

The refrigeration system may include a compressor 50, condenser 52 for condensing compressed refrigerant vapor discharged from the compressor 50, a condensing fan 54 positioned to blow a gaseous cooling medium across condenser 52, a drier 56, a heat exchanger 58, a form of thermal expansion device 60 for lowering the temperature and pressure of the refrigerant, a strainer 62, and hot gas bypass valve 64. As described more fully elsewhere herein, a form of refrigerant cycles through tubing fluidly connecting these components.

Thermal expansion device 60 may include, but is not limited to, a capillary tube (as illustrated in FIG. 3), a thermostatic expansion valve or an electronic expansion valve. In certain embodiments, where thermal expansion device 60 is a thermostatic expansion valve or an electronic expansion valve, the water system may also include a temperature sensing bulb placed at the outlet of the evaporator assembly 32 to control thermal expansion device 60. In other embodiments, where thermal expansion device 60 is an electronic expansion valve, the water system may also include a pressure sensor (not shown) placed at the outlet of the evaporator assembly 32 to control thermal expansion device 60 as is known in the art. The outlet of the evaporator assembly 32 may also include an accumulator 66 designed to hold liquid refrigerant during the freeze cycle to prevent the liquid refrigerant from surging back to the compressor 50.

The refrigeration system, as well as the water system, may be controlled by a controller for the startup, freezing, and harvesting cycles through a series of relays. The controller may include a processor along with processor-readable medium storing code representing instructions to cause processor to perform a process. The processor may be, for example, a commercially available microprocessor, an application-specific integrated circuit (ASIC) or a combination of ASICs, which are designed to achieve one or more specific functions, or enable one or more specific devices or applications. In yet another embodiment, the controller may be an analog or digital circuit, or a combination of multiple circuits. The controller may also include one or more memory components (not shown) for storing data in a form retrievable by the controller. The controller can store data in or retrieve data from the one or more memory components. The controller may also include a timer for measuring elapsed time. The timer may be implemented via hardware and/or software on or in the controller and/or in the processor in any manner known in the art without departing from the scope of the invention.

Having described each of the individual components of one embodiment of the refrigeration and water systems, the manner in which the components interact and operate in various embodiments may now be described in reference again to FIGS. 3 and 4. Initially, the refrigeration system is charged with a refrigerant. During operation, the compressor 50 receives low-pressure, substantially gaseous refrigerant from evaporator assembly 32 through output line 68. The compressor 50 pressurizes the refrigerant, and discharges high-pressure, substantially gaseous refrigerant to condenser 52. The difference in pressure between suction side of the compressor 50 and the discharge side of the compressor 50 may be determined using two pressure sensors located on the suction and discharge lines, Ps and Pd. In condenser 52, heat is removed from the refrigerant, causing the substantially gaseous refrigerant to condense into a substantially liquid refrigerant.

After exiting condenser 52, the high-pressure, substantially liquid refrigerant is routed through the drier 56 to remove moisture and, if the drier 56 includes a form of filter such as a mesh screen, to remove certain particulates in the liquid refrigerant. The refrigerant then passes through a heat exchanger 58, which uses the warm liquid refrigerant leaving the condenser 52 to heat the cold refrigerant vapor leaving the evaporator assembly 32, and into the thermal expansion device 60, which reduces the pressure of the substantially liquid refrigerant for introduction into evaporator assembly 32. As the low-pressure expanded refrigerant is passed through the tubing of evaporator assembly 32, the refrigerant absorbs heat from the tubes contained within evaporator assembly 32 and vaporizes as the refrigerant passes through the tubes, thus cooling evaporator 32 and its horizontal freeze plate 34. Low-pressure, substantially gaseous refrigerant is discharged from the outlet of evaporator assembly 32 through line 68, and is reintroduced into the inlet of the compressor 50.

To initiate the harvest, traditional ice making machines monitor the level of falling water and signal the controller, for example through means of a float, when the desired batch weight has been reached. Another method, explained in U.S. Pat. No. 5,878,583, describes using a single parameter, such as measuring the ambient temperature, and referencing a tabulated chart stored in the controller's memory to determine the proper timing of the system. A similar method, explained in U.S. Pat. No. 7,281,386, monitors the liquid line temperature exiting the condenser to adjust the timing sequence of the machine. Both of these methods simplify and reduce the number of components needed to precisely control the ice machine.

In certain embodiments, at the start of the cooling cycle, water inlet valve 42 may be turned on to supply water to reservoir 26. After the desired level of water is supplied to reservoir 26, the water inlet valve 42 may be closed. Water pump 28 circulates the water from reservoir 26 into the sprayer assembly 30 in order to spray water up into the pockets 36 of the freeze plate 34. The water that is supplied by water pump 28 then, during the sensible cooling cycle, begins to cool as it contacts freeze plate 34, returns to water reservoir 26 below freeze plate 34 and is recirculated by water pump 28 to the sprayer assembly 30. Once the cooling cycle enters the latent cooling cycle, water sprayed into the pockets 36 starts forming ice cubes. As the volume of ice increases on the freeze plate 30, simultaneously the volume of water in the reservoir 26 decreases. The controller may monitor either the amount of ice forming as measured by an ice thickness sensor, the decrease in the water in the reservoir 26 as measured by the water level sensor, or some other refrigeration system parameter to determine the desirable batch weight. Thus, the controller can monitor the water level in reservoir 26 and can control the various components accordingly.

At that point, the harvesting portion of the cycle begins. To initiate the harvest, traditional ice making machines monitor the level of falling water and signal the controller, for example through means of a float, when the desired batch weight has been reached. Another method, explained in U.S. Pat. No. 5,878,583, describes using a single parameter, such as measuring the ambient temperature, and referencing a tabulated chart stored in the controller's memory to determine the proper timing of the system. A similar method, explained in U.S. Pat. No. 7,281,386, monitors the liquid line temperature exiting the condenser to adjust the timing sequence of the machine. Both of these methods simplify and reduce the number of components needed to precisely control the ice machine. The controller opens the purge valve 48 to remove the remaining water and impurities from the reservoir 26. The water system and the refrigeration system are disabled. After the ice cubes are formed, hot gas valve 64 is opened allowing warm, high-pressure gas from compressor 50 to flow through a hot gas bypass line, through strainer 62 capable of removing particulates from the gas, to enter the tubing of the evaporator assembly 32, thereby harvesting the ice by warming freeze plate 34 to melt the formed ice to a degree such that the ice may be released from the pockets 36 of the freeze plate 34 and fall downward. As the ice falls, the ice lands on an inclined ice slide 70, pushing at least portions of the divider assembly 18 at least partially open such that the ice falls into the ice storage bin 16 where the ice can be temporarily stored and later retrieved. The hot gas valve 64 is then closed and the cooling cycle can repeat.

Figure 5:
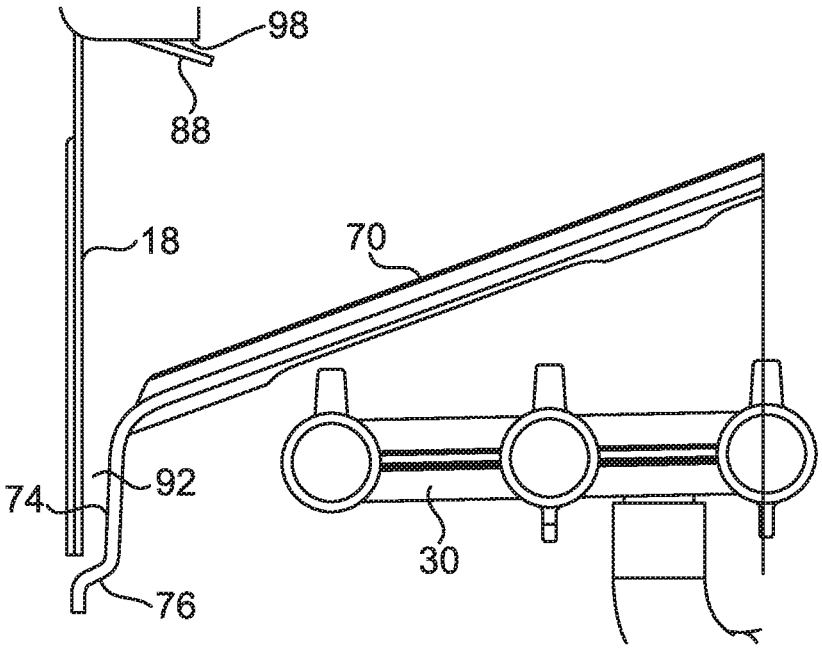
FIG. 5 is a side view of the ice slide and divider assembly according to one embodiment of the present invention.
Figure 6:
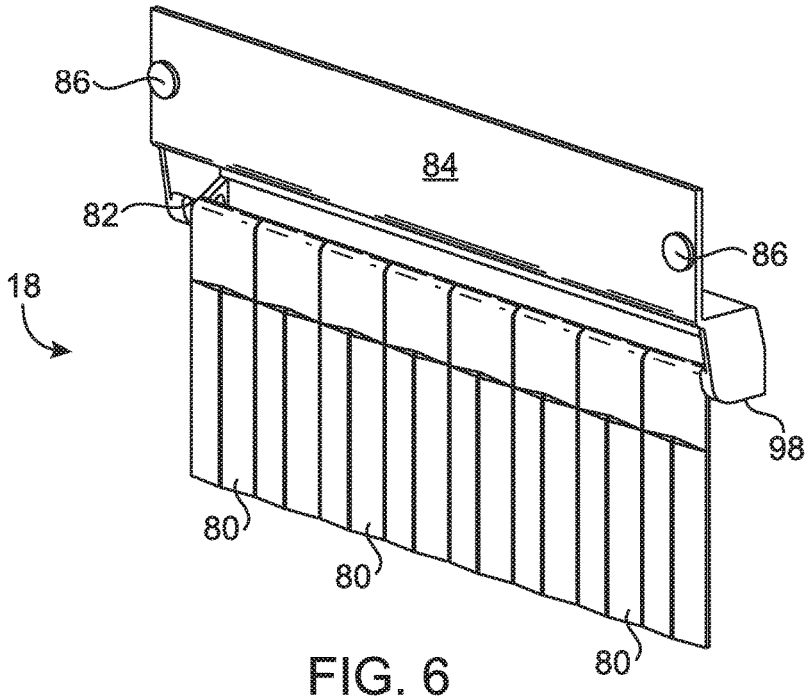
FIG. 6 is a front perspective view of the divider assembly according to one embodiment of the present invention.
Figure 7:
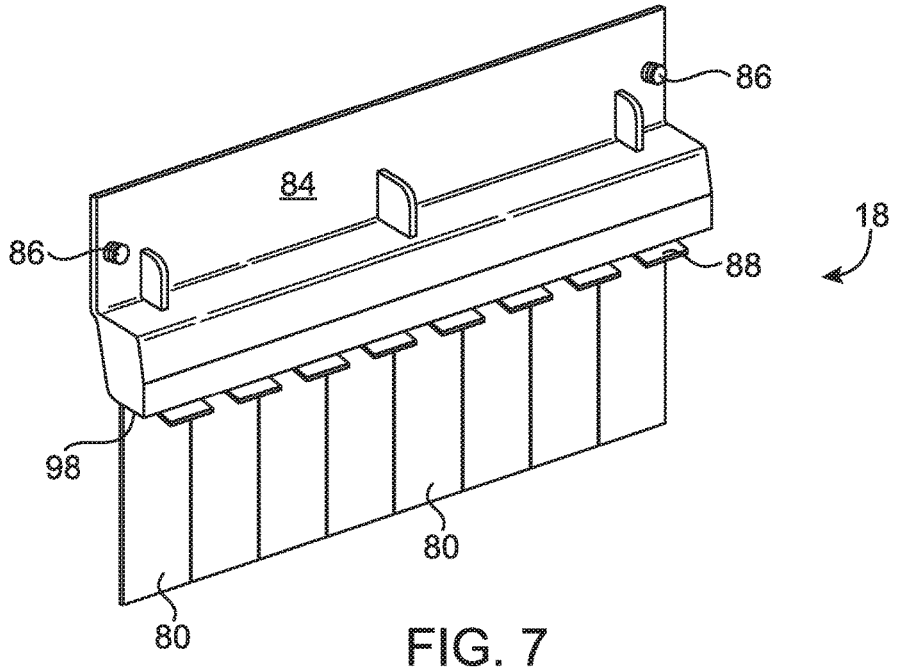
FIG. 7 is a rear perspective view of the divider assembly according to one embodiment of the present invention.

FIGS. 4 and 5 illustrate certain details of the ice slide 70 and its relationship with the divider assembly 18. The ice slide 70 is inclined downward to the opening of the ice making assembly to direct fallen ice into the ice storage bin 16. The opening separates the ice making components from the ice storage bin 16. Inclined ice slide 70 is preferably designed to permit water sprayed upward by the sprayer assembly 30 to pass through the slide 70 to reach the pockets 36 of the freeze plate 34 of the evaporator assembly 32. Thus, the ice slide 70 may include a plurality of holes or slots 72 there through. The holes or slots 72 are dimensioned permit the sprayed water to pass through the ice slide 70 while preferably not allowing finished ice cubes to pass through. The ice slide 70 also includes an end face 74 formed downwardly away from the freeze plate 34 and in a direction toward the water reservoir 26. During the ice making process, water yet to be formed into ice may fall from the pockets 36, trail down the ice slide 70 over the end face 74 and through a series of drain holes 76 located downstream of the end face 74 to direct water back into the water reservoir 26. The divider assembly 18 preferably prevents water from escaping the ice making assembly 14 through the opening and into the storage bin 16 or elsewhere during the ice making process.

FIGS. 6-12 illustrate certain preferred features of the divider assembly 18, which divides the ice making assembly 14 from the ice storage bin 16 and other areas of the ice maker 10. Preferably, the divider assembly 18 includes a number of individual dividers 80, for example, eight dividers, rotatably hung from a hanging rod 82 such that the dividers 80 span the width of the opening of the ice making assembly and hover over the adjacent ice slide 70 as illustrated in FIG. 5. Each divider is a generally rectangular, generally flat member made out of a form of plastic or other suitable material. The dividers 80 may be attached to the rod 82 by sliding the rod 82 through a channel 90 in the upper portion, or proximal end, of each divider 80. Preferably, the dividers 80 may be placed on the rod 82 to limit the amount of space between dividers 80. Thus, the dividers 80 are preferably flat on their sides to permit the dividers to rest snuggly against one another. The rod 82 is connected to an attachment bracket 84 such that the entire divider assembly 18 may be attached to the upper housing of the ice making machine 10.

Each divider 80 is designed to hang from the rod 82 by gravity, to prevent contact between the divider 80 and the end face 74 of the ice slide 70, to rotate into an open position when sufficiently engaged by fallen ice, yet not stick to the flat surface 22 of the outer-upper housing of ice maker 10. Thus, each divider 80 preferably includes an angled flap 88, which is angled downwardly from the rod 82 away from the front face 94 of the divider 80. The angled flap 88 may be angled downwardly off the horizontal plane at an angle of about 17.5 degrees. The angled flap 88 has a weight and length with respect to the remaining portion of the divider 80 such that the divider 80 remains in a vertical orientation during the ice making phase to prevent water from escaping the ice making assembly 14, yet rotate into an open position as ice is discharged from the freeze plate 34, falls downward, and slides down the ice slide 70 and into the ice storage bin 16. For example, in one embodiment, the flap may be about one inch in length as the divider 80 is about 4 to about 4.5 inches in length. The angled flap 88 assists in preventing the divider 80 from sticking to the end face 74 of the ice slide 70 via surface tension as any unfrozen water returns to the reservoir 26 by being of a size and shape to help pivot the divider 80 away from the end face 74. Thus, when the dividers 80 are in the normally closed position (i.e., hanging straight down due to gravity), the angled flap 88 prevents the divider 80 from contacting the end face 74 of the ice slide 70 by contacting the inner horizontal surface 98 of the attachment bracket 84. The preferred range of the angle of the flap 88 downwardly off the horizontal plane is related to the width of the gap 92 defined between the distal end of the dividers 80 and the end face 74 of the ice slide 70. Preferably, the angle (about 17.5 degrees, with a tolerance of +/−0.5 degrees) of the flap 88 is such that in the event the divider 80 rotates inwardly, the flap 88 will contact the inner horizontal surface 98 of the attachment bracket before the distal end of the divider 80 comes into contact with the end face 74 of the ice slide 70. Preventing contact between the distal end of the divider 80 and the end face 74 allows unfrozen water to flow through the gap, to the drain holes, and back into the water reservoir 26. Additionally, preventing contact between the distal end of the divider 80 and the end face 74 avoids the problem in the prior art of the divider 80 failing to rotate open to allow formed ice to flow through to the ice bin 16 due to surface tension.

As shown in FIG. 5, the dividers 80 have a length such that the dividers 80 fall in front of, but do not touch, the end face 74 of the ice slide 70, leaving a gap 92 to permit unfrozen water to flow back into the water reservoir 26. In one embodiment, the length of the dividers may be about 4.0 to 4.5 inches. As shown in FIG. 5, preferably each divider 80 has a length permitting the divider 80 to extend down to about the bottom of the end face 74 of the ice slide 70 adjacent the drain holes 76.

Figure 8:
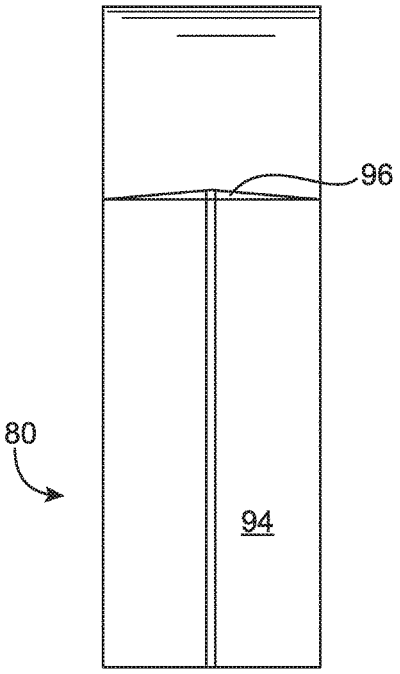
FIG. 8 is a front view of a divider according to one embodiment of the present invention.
Figure 9:
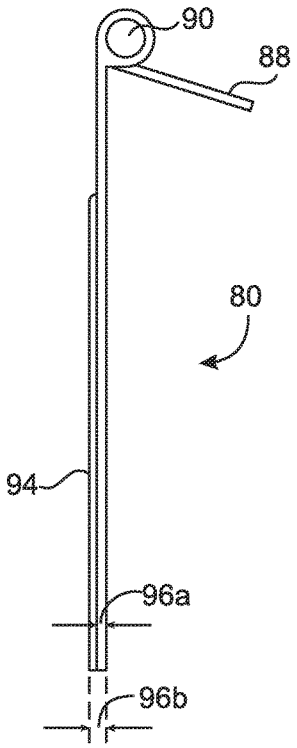
FIG. 9 is a side view of a divider according to one embodiment of the present invention.
Figure 10:
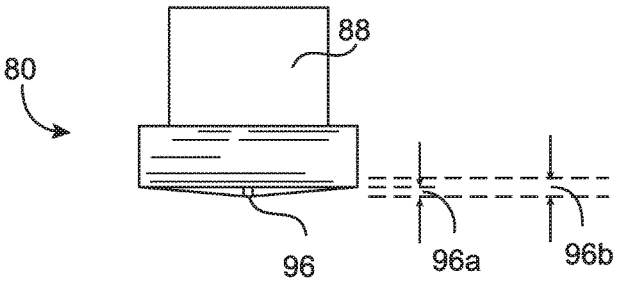
FIG. 10 is a top view of a divider according to one embodiment of the present invention.
Figure 11:
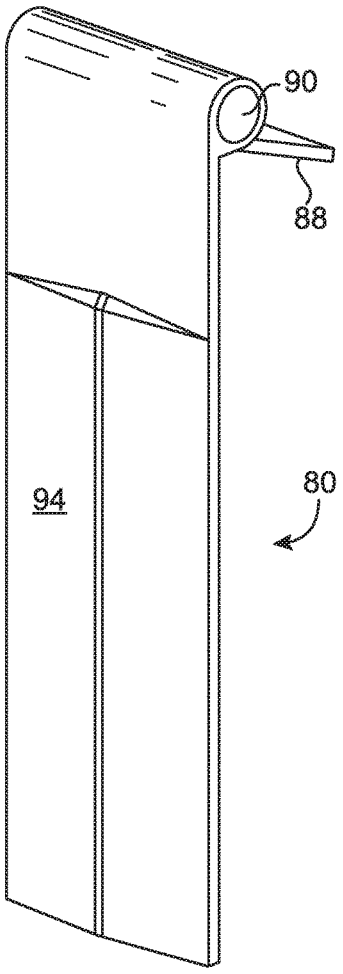
FIG. 11 is a perspective view of a divider according to one embodiment of the present invention.
Figure 12:
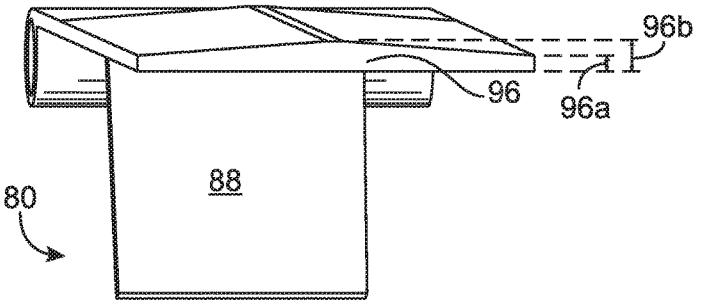
FIG. 12 is a rear perspective view of a divider according to one embodiment of the present invention.

The front face 94 of each divider 80 may have features to assist in performing the function of the divider assembly 18. The front face 94 of each divider 80 includes a triangular-shaped thickness 96 to prevent contact with the flat surface 22 of the outer-upper housing. The thickness 96 further provides an added moment of inertia needed to prevent the divider from opening due to sprayed water. The thickness 96 may extend the entire length, or only a portion, of the divider 80. For example, as shown in FIG. 8, the thickness may extend over the lower approximately three-quarters of the front face 94 of the divider 80. As shown in FIG. 12, the triangular-shaped thickness 96 may increase in thickness on the edge of the divider 80 (as identified by 96*a*) to its thickest point in the horizontal middle of the divider (as identified by 96*b*). Preferably, the dimension 96*b* is about twice that of 96*a* (200%), but may range from about 125% to about 300%). For example, in certain embodiments, dimension 96*a* may be about 0.050 inches and dimension 96*b* may be about 0.110 inches, each with a tolerance of about 0.015 inches. The width of each divider 80 may be about 1.4 inches, and each divider 80 may weigh about 10.5 grams. The thickness 96 adds weight to the divider 80 to enable faster closing speeds after ice is discharged through the opening and increases the moment of inertia on the front face 94 providing a tighter close.

Thus, there has been shown and described novel components of a vertical spray-type ice making machines having a unique divider assembly for separating the ice-making zone from the ice storage bin. It will be apparent, however, to those familiar in the art, that many changes, variations, modifications, and other uses and applications for the subject devices and methods are possible. All such changes, variations, modifications, and other uses and applications that do not depart from the spirit and scope of the invention are deemed to be covered by the invention which is limited only by the claims which follow.

The invention claimed is:

1. An ice maker comprising:

a refrigeration system comprising a compressor, a condenser, a hot gas valve, and a thermal expansion device;

an evaporator assembly comprising a refrigerant tubing in fluid communication with the refrigeration system such that refrigerant may cycle through the refrigerant tubing and the refrigeration system, and a freeze plate thermally coupled to the refrigerant tubing, the freeze plate compromising a plurality of ice-forming pockets;

a water system for supplying water to the pockets of the freeze plate, the water system comprising a water reservoir located below the freeze plate adapted to hold water, a sprayer assembly located below the freeze plate for spraying water from the water reservoir toward the pockets, wherein the sprayer assembly is in fluid communication with the reservoir by a water line to cycle water up toward the pockets of the freeze plate;

an ice storage bin for retaining the formed ice;

an inclined ice slide positioned below the freeze plate and above the sprayer assembly directing fallen ice toward an opening between the water system and the ice storage bin;

a divider assembly within the opening, the divider assembly comprising a plurality of dividers, wherein the dividers may rotate about an axis of rotation at a proximal end of the dividers outwardly away from the opening to allow formed ice to fall into the ice storage bin, wherein each of the plurality of dividers comprises:

a generally rectangular body comprising a front face and an extension flap at the proximal end of the divider extending away from the body opposite the front face.

2. The ice maker of claim 1 wherein the front face of the dividers comprises a triangular-shaped thickness.

3. The ice maker of claim 1 wherein the ice slide further comprises a generally horizontal end face terminating in a plurality of drain holes to direct water back into the reservoir.

4. The ice maker of claim 1 wherein the dividers are capable of rotating from a normally closed position into an open position allowing formed ice to reach the ice bin.

5. The ice maker of claim 4 wherein the distal end of the dividers in their closed position and the end face of the ice slide define a gap separating the distal end of the dividers and the end face of the ice slide.

6. The ice maker of claim 5 wherein the divider assembly further comprises an attachment bracket for securing the dividers to the ice maker, the attachment bracket comprises an inner horizontal surface and wherein the extension flap engages with the inner horizontal surface to maintain the gap between the distal end of the dividers and the end face of the ice slide.

7. An ice discharging apparatus for use in a vertical spray-type ice making machine having a water spraying assembly positioned below a freeze plate, and an ice bin, the discharging apparatus comprising:

an inclined ice slide positioned below the freeze plate and above the sprayer assembly directing fallen ice toward an opening to the ice storage bin;

a divider assembly within the opening, the divider assembly comprising a plurality of dividers, wherein the dividers may rotate about an axis of rotation at a proximal end of the dividers outwardly away from the opening to allow formed ice to fall into the ice storage bin, wherein each of the plurality of dividers comprises:

a generally rectangular body comprising a front face and an extension flap at the proximal end of the divider extending away from the body opposite the front face.

8. The apparatus of claim 7 wherein the front face of the dividers comprises a triangular-shaped thickness.

9. The apparatus of claim 7 wherein the ice slide further comprises a generally horizontal end face terminating in a plurality of drain holes to direct water back into the reservoir.

10. The apparatus of claim 7 wherein the dividers are capable of rotating from a normally closed position into an open position allowing formed ice to reach the ice bin.

11. The apparatus of claim 10 wherein the distal end of the dividers in their closed position and the end face of the ice slide define a gap separating the distal end of the dividers and the end face of the ice slide.

12. The apparatus of claim 11 wherein the divider assembly further comprises an attachment bracket for securing the dividers to the ice maker, the attachment bracket comprises an inner horizontal surface and wherein the extension flap engages with the inner horizontal surface to maintain the gap between the distal end of the dividers and the end face of the ice slide.

* * * * *